US009791798B2

(12) United States Patent
Nishitera

(10) Patent No.: US 9,791,798 B2
(45) Date of Patent: Oct. 17, 2017

(54) ELECTROSTATIC LATENT IMAGE DEVELOPING TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/435,467

(22) Filed: Feb. 17, 2017

(65) Prior Publication Data

US 2017/0242360 A1 Aug. 24, 2017

(30) Foreign Application Priority Data

Feb. 23, 2016 (JP) ..... 2016-032034

(51) Int. Cl.
*G03G 9/093* (2006.01)
*G03G 9/087* (2006.01)
*G03G 9/08* (2006.01)

(52) U.S. Cl.
CPC ..... *G03G 9/09321* (2013.01); *G03G 9/0825* (2013.01); *G03G 9/08755* (2013.01)

(58) Field of Classification Search
CPC ..... G03G 9/08702; G03G 9/08724
See application file for complete search history.

(56) References Cited

U.S. PATENT DOCUMENTS 8,940,468 B2 1/2015 Aoki et al.
2013/0011777 A1* 1/2013 Aoki ..... G03G 9/08755 430/105

FOREIGN PATENT DOCUMENTS

JP 2009-256288 * 11/2009 ..... C07C 69/732
JP 2013-019971 A 1/2013

OTHER PUBLICATIONS

Translation of JP 2009-256288 published Nov. 2009.*

* cited by examiner

*Primary Examiner* — Peter Vajda
(74) *Attorney, Agent, or Firm* — Studebaker & Brackett PC

(57) ABSTRACT

An electrostatic latent image developing toner includes a plurality of toner particles each including a core containing a binder resin and a shell layer covering a surface of the core. The shell layer contains a copolymer of at least two compounds including a compound represented by formula (1) shown below. In the formula (1), $R^{11}$ represents a hydrogen atom or an optionally substituted alkyl group having a carbon number of at least 1 and no greater than 8, and $R^{12}$ represents an optionally substituted linear alkyl group having a carbon number of at least 8 and no greater than 22.

(1)

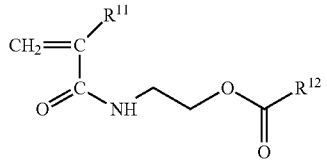

10 Claims, No Drawings

ELECTROSTATIC LATENT IMAGE DEVELOPING TONER

INCORPORATION BY REFERENCE

The present application claims priority under 35 U.S.C. §119 to Japanese Patent Application No. 2016-032034, filed on Feb. 23, 2016. The contents of this application are incorporated herein by reference in their entirety.

BACKGROUND

The present disclosure relates to electrostatic latent image developing toners, and in particular relates to a capsule toner.

There has been known a technique for improving preservability of a toner by for example using a reactive polymer having an oxazoline group as a crosslinking agent.

SUMMARY

An electrostatic latent image developing toner according to the present disclosure includes a plurality of toner particle each including a core containing a binder resin and a shell layer covering a surface of the core. The shell layer contains a copolymer of at least two vinyl compounds including a compound represented by formula (1) shown below.

(1)

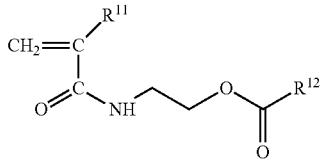

In the formula (1), $R^{11}$ represents a hydrogen atom or an optionally substituted alkyl group having a carbon number of at least 1 and no greater than 8, and $R^{12}$ represents an optionally substituted linear alkyl group having a carbon number of at least 8 and no greater than 22.

DETAILED DESCRIPTION

The following describes an embodiment of the present disclosure in detail. Unless otherwise stated, evaluation results (for example, values indicating shape and physical properties) for a powder (specific examples include toner cores, toner mother particles, an external additive, and a toner) are number averages of values measured for a suitable number of representative particles.

Unless otherwise stated, the number average particle diameter of a powder is a number average value of diameters of representative circles of primary particles (i.e., diameters of circles each having the same area as a projection of the particle) measured using a microscope. Unless otherwise stated, a measurement value of the volume median diameter ($D_{50}$) of a powder is a value measured using a laser diffraction/scattering particle size distribution analyzer ("LA-750" manufactured by HORIBA, Ltd.).

Unless otherwise stated, a glass transition point (Tg) is a value measured using a differential scanning calorimeter ("DSC-6220" manufactured by Seiko Instruments Inc.) in accordance with "Japan Industrial Standard (JIS) K7121-2012". On a heat absorption curve (vertical axis: heat flow (DSC signals), horizontal axis: temperature) at a second temperature increase measured by the differential scanning calorimeter, a temperature (onset temperature) at a point of variation in specific heat (an intersection point of an extrapolation of the base line and an extrapolation of the inclined portion of the curve) corresponds to a glass transition point (Tg). Furthermore, unless otherwise stated, a softening point (Tm) is a value measured using a capillary rheometer ("CFT-500D" manufactured by Shimadzu Corporation). On an S-shaped curve (horizontal axis: temperature, vertical axis: stroke) measured by the capillary rheometer, a temperature at "(base line stroke value+maximum stroke value)/2" corresponds to a softening point (Tm). Respective measurement values of an acid value and a hydroxyl value are values measured in accordance with Japan Industrial Standard (JIS) K0070-1992 unless otherwise stated. A number average molecular weight (Mn) and a mass average molecular weight (Mw) are values measured by gel permeation chromatography unless otherwise stated.

Unless otherwise stated, chargeability means a chargeability at triboelectric charging. Intensity of positive chargeability (or negative chargeability) at the triboelectric charging can be determined using for example a known triboelectric series.

In the present specification, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present specification, the term "(meth)acryl" is used as a generic term for both acryl and methacryl. Acrylonitrile and methacrylonitrile may be referred collectively to as "(meth)acrylonitrile".

Subscripts "n" of respective repeating units in chemical formulas each represent, independently of one another, the number of repetitions (number of moles) of the repeating unit. Unless otherwise stated, n (the number of repetitions) is any suitable value. A group represented by a specific sign in a chemical formula may be referred to below as the sign. For example, a group represented by $R^{11}$ may be referred simply to "$R^{11}$"

A toner according to the present embodiment can favorably be used as for example a positively chargeable toner for development of an electrostatic latent image. The toner according to the present embodiment is a powder containing a plurality of toner particles (particles each having features described later in detail). The toner may be used as a one-component developer. Alternatively, the toner may be mixed with a carrier using a mixer (for example, a ball mill) to prepare a two-component developer. A ferrite carrier (a powder of ferrite particles) is preferably used as the carrier in order to form a high-quality image. It is preferable to use magnetic carrier particles each including a carrier core and a resin layer that covers the carrier core in order to form high-quality images for a long period of time. Carrier cores may be formed from a magnetic material (for example, a ferromagnetic material such as a ferrite) or a resin in which magnetic particles are dispersed in order to impart magnetism to the carrier particles. Alternatively, magnetic particles may be dispersed in resin layers that cover respective carrier cores. The amount of the toner in a two-component developer is preferably at least 5 parts by mass and no greater than 15 parts by mass relative to 100 parts by mass of the carrier in order to form a high-quality image. Note that a positively chargeable toner contained in a two-component developer is positively charged by friction with a carrier.

The toner particles contained in the toner according to the present embodiment each include a core (also referred to below as a toner core) containing a binder resin and a shell layer (capsule layer) covering a surface of the toner core. The toner core may optionally contain an internal additive (for example, at least one of a colorant, a releasing agent, a charge control agent, and a magnetic powder). The shell layer is formed substantially from a resin. For example, covering toner cores that melt at low temperature with shell layers excellent in heat resistance can achieve both excellent high-temperature preservability and excellent low-temperature fixability of the toner. An additive may be dispersed in the resin forming the shell layers. An external additive may be attached to the surfaces of the shell layers (or surface regions of the toner cores that each are not covered with a shell layer). Furthermore, a plurality of shell layers may be stacked on the surface of the toner core. Note that the external additive may be omitted in a situation in which such an additive is not necessary. Hereinafter, toner particles that are yet to be subjected to addition of an external additive are referred to as toner mother particles. A material for forming the shell layers is referred to as a shell material.

The toner according to the present embodiment can be used for example for image formation using an electrophotographic apparatus (image forming apparatus). The following describes an example of an image forming method using an electrophotographic apparatus.

First, an image forming section (a charger and an exposure device) of the electrophotographic apparatus forms an electrostatic latent image on a photosensitive member based on image data. Subsequently, a developing device (specifically, a developing device charged with a developer containing toner) of the electrophotographic apparatus supplies the toner to the photosensitive member to develop the electrostatic latent image formed on the photosensitive member. The toner is charged by friction with a carrier, a developing sleeve, or a blade in the developing device before being supplied to the photosensitive member. For example, a positively chargeable toner is charged positively. In a developing process, toner (specifically, charged toner) on the developing sleeve (for example, a surface layer portion of a development roller in the developing device) disposed in the vicinity of the photosensitive member is supplied to the photosensitive member to be attached to the electrostatic latent image on the photosensitive member, thereby forming a toner image on the photosensitive member. The developing device is replenished with toner for replenishment use from a toner container in compensation for consumed toner.

In a subsequent transfer process, a transfer device of the electrophotographic apparatus transfers the toner image on the photosensitive member to an intermediate transfer member (for example, a transfer belt) and further transfers the toner image on the intermediate transfer member to a recording medium (for example, paper). Thereafter, a fixing device (fixing method: nip fixing using a heating roller and a pressure roller) of the electrophotographic apparatus applies heat and pressure to the toner to fix the toner to the recording medium. As a result, an image is formed on the recording medium. A full-color image can be formed by superimposing toner images formed using different four color toners such as black, yellow, magenta, and cyan.

The toner according to the present embodiment is an electrostatic latent image developing toner having the following features (also referred to below as basic features).

(Basic Features of Toner)

The electrostatic latent image developing toner contains a plurality of toner particles each including a toner core and a shell layer. The shell layer contains a copolymer of at least two vinyl compounds including a compound represented by the above formula (1).

The vinyl compounds each are a compound having a vinyl group ($CH_2$=CH—) or a compound having a substituted vinyl group. Examples of the vinyl compounds include ethylene, propylene, butadiene, vinyl chloride, acrylic acid, methyl acrylate, methacrylic acid, methyl methacrylate, acrylonitrile, and styrene. The vinyl compounds can each be a polymer (resin) through addition polymerization by carbon double bonding "C=C" included in for example the vinyl group.

The compound represented by the above formula (1) (referred to below as a compound (1)) becomes a repeating unit represented by the following formula (1-1) through addition polymerization to constitute a copolymer.

(1-1)

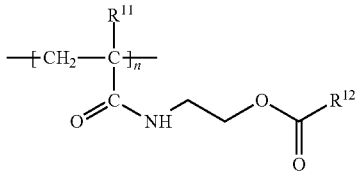

The shell layers in the toner having the above basic features contain a copolymer of at least two vinyl compounds including a compound represented by the above formula (1) (also referred to below as a specific copolymer). The specific copolymer is a copolymer of at least one vinyl compound represented by the above formula (1) and at least one vinyl compound other than the vinyl compound represented by formula (1). In the above configuration, the repeating unit (1-1) is present in a resin (specifically, the specific copolymer) forming the shell layers. The repeating unit (1-1) has low absorbability and therefore tends to be excellent in charge retention. The reason therefor is thought to be that the repeating unit (1-1) has $R^{12}$ (an optionally substituted linear alkyl group having a carbon number of at least 8 and no greater than 22) having a carbon chain with an appropriate length. The inventor has found that utilization of a characteristic of an oxazoline group can bring chemical bonding of the $R^{12}$ to the surfaces of the shell layers. The oxazoline group that has comparatively strong hydrophilicity tends to lose the hydrophilicity once the ring thereof is opened. In the presence of the repeating unit (1-1) in a resin forming the shell layers, sufficient chargeability of the toner can be easily ensured even in high-temperature and high-humidity ambient conditions.

The inventor has further found that $R^{12}$ in the repeating unit (1-1) imparts releasability to the toner particles. In addition, the shell layers impart releasability to the toner particles in the toner having the aforementioned basic features and therefore releasability of the toner can be improved without involving an increase in amount of a releasing agent (internal additive) in the toner cores. An increase in amount of the releasing agent in the toner cores tends to invite separation of the releasing agent from the toner cores. Separate releasing agent may serve as a factor of fogging and contamination in an apparatus. In a configuration with the aforementioned basic features, releasability of the toner can be improved while avoiding disadvantage from such separate releasing agent. In order to avoid disadvantage from separate releasing agent, the amount of the releasing agent contained in the toner cores is preferably at least 2.50 parts by mass relative to 100 parts by mass of the binder resin of the toner cores, more preferably at least 0.50 parts by mass, and further more preferably 0.00 parts by mass (that is, the toner cores contains no releasing agent).

The following describes a suitable shell material.

In the above formula (1), $R^{11}$ represents a hydrogen atom or an optionally substituted linear, branched, or cyclic alkyl group having a carbon number of at least 1 and no greater than 8, and $R^{12}$ represents an optionally substituted linear alkyl group having a carbon number of at least 8 and no greater than 22. Examples of suitable $R^{11}$ include a hydrogen atom, a methyl group, an ethyl group, and a propyl group. Examples of suitable $R^{12}$ include an octyl group (linear alkyl group having a carbon number of 8), a decyl group (linear alkyl group having a carbon number of 10), a dodecyl group (linear alkyl group having a carbon number of 12), an octadecyl group (linear alkyl group having a carbon number of 18), and a docosyl group (linear alkyl group having a carbon number of 22). The carbon number that $R^{12}$ has is preferably at least 12 and more preferably at least 18 in order to improve releasability and chargeability of the toner.

The specific copolymer includes a repeating unit derived from a vinyl compound other than the compound (1) (referred to below as other vinyl compound). At least one vinyl compound selected from the group consisting of styrene-based monomers and acrylic acid-based monomers is preferable as the other vinyl compound. Examples of preferable styrene-based monomers include styrene, alkyl styrene (specific examples include α-methylstyrene, m-methylstyrene, p-methylstyrene, and p-ethylstyrene), hydroxystyrene (specific examples include p-hydroxystyrene and m-hydroxystyrene), and halogenated styrene (specific examples include α-chlorostyrene, o-chlorostyrene, m-chlorostyrene, and p-chlorostyrene). By contrast, examples of preferable acrylic acid-based monomers include (meth)acrylic acid, (meth)acrylic acid alkyl ester, (meth)acrylic acid hydroxyalkyl ester, (meth)acrylic acid aryl ester, (meth)acrylonitrile, and (meth)acrylamide.

For example, in a configuration in which the other vinyl compound is an acrylic acid alkyl ester optionally substituted by an alkyl group, the acrylic acid alkyl ester becomes a repeating unit for example represented by the following formula (2) through addition polymerization to constitute a copolymer.

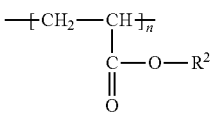

(2)

In formula (2), $R^2$ represents an optionally substituted linear, branched, or cyclic alkyl group. An alkyl group having a carbon number of at least 1 and no greater than 8 is preferable as the alkyl group. In a configuration in which $R^2$ represents a substituted alkyl group, a hydroxyl group is preferable as a substituent of the substituted alkyl group. Examples of preferable $R^2$ include a methyl group, an ethyl group, an n-propyl group, an iso-propyl group, an n-butyl group, an iso-butyl group, a 2-ethylhexyl group, a hydroxyethyl group, a hydroxypropyl group, and a hydoxybutyl group.

In a configuration for example in which the other vinyl compound is an optionally substituted methacrylic acid alkyl ester, the optionally substituted methacrylic acid alkyl ester becomes for example a repeating unit represented by the following formula (3) through addition polymerization to constitute a copolymer.

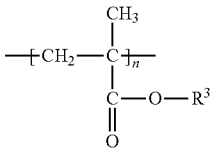

(3)

In formula (3), R represents an optionally substituted linear, branched, or cyclic alkyl group. An alkyl group having a carbon number of at least 1 and no greater than 8 is preferable as the alkyl group. In a configuration in which $R^3$ represents a substituted alkyl group, a hydroxyl group is preferable as a substituent of the substituted alkyl group. Examples of preferable $R^3$ include a methyl group, an ethyl group, an n-propyl group, an iso-propyl group, an n-butyl group, an iso-butyl group, a 2-ethylhexyl group, a hydroxyethyl group, a hydroxypropyl group, and a hydoxybutyl group.

In a configuration for example in which the other vinyl compound is a styrene-based monomer, the styrene-based monomer becomes a repeating unit for example represented by the following formula (4) through addition polymerization to constitute a copolymer.

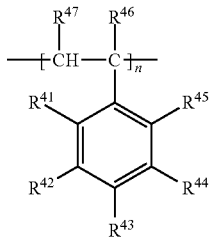

(4)

In formula (4), $R^{41}$ to $R^{47}$ each represent, independently of one another, a hydrogen atom or any suitable substituent. Preferably, $R^{41}$ to $R^{45}$ each represent, independently of one another, a halogen atom, a hydroxyl group, an optionally substituted alkyl group, or an optionally substituted aryl group. A halogen atom, a methyl group, an ethyl group, or a hydroxyl group is particularly preferable as $R^{41}$ to $R^{45}$ independently of one another. Preferably, $R^{46}$ and $R^{47}$ each represent, independently of one another, a hydrogen atom or a methyl group.

The specific copolymer may have a repeating unit having a ring unopened oxazoline group (for example, a repeating unit derived from a compound represented by the following formula (5)). The compound represented by formula (5) (referred to below as a compound (5)) becomes a repeating unit represented by the following formula (5-1) (referred to below as a repeating unit (5-1)) through addition polymerization to constitute a copolymer. An oxazoline group in the repeating unit (5-1) and the binder resin forming the toner cores may react with each other at interfaces between the shell layers and the toner cores.

(5)

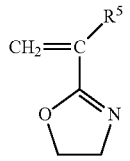

In the above formula (5), $R^5$ represents a hydrogen atom or an optionally substituted linear, branched, or cyclic alkyl group having a carbon number of at least 1 and no greater than 8. Preferably, $R^5$ represents a hydrogen atom, a methyl group, an ethyl group, or a propyl group with a hydrogen atom or a methyl group being particularly preferably.

(5-1)

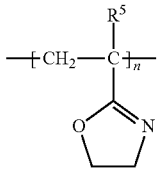

The repeating unit (5-1) has a ring unopened oxazoline group. The ring unopened oxazoline group has cyclic structure to exhibit strong positive chargeability. The ring unopened oxazoline group tends to react with a carboxyl group, an aromatic sulfanyl group, and an aromatic hydroxyl group. The oxazoline group in the repeating unit (5-1) is ring-opened for example through a reaction with a functional group present on the surface of the binder resin forming the toner cores. The ring opened oxazoline group can form cross-linking structure. In a configuration for example in which the binder resin of the toner cores is a polyester resin, the oxazoline group in the repeating unit (5-1) reacts with a carboxyl group of the polyester resin to form an amid ester bond. When the cross-linking structure is formed through a reaction of the oxazoline group in the shell layers with the binder resin of the toner cores, heat resistance of the toner tends to be improved in the presence of the cross-linking structure while positive chargeability of the shell layers may be impaired.

For example, a reaction between the compound (5) and a fatty acid having a carbon chain having a carbon number of at least 8 and no greater than 22 can yield the aforementioned compound (1). Addition polymerization of the compound (1) can yield a resin having the repeating unit (1-1). A reaction of the repeating unit (5-1) having been introduced into a resin with a fatty acid having a carbon chain having a carbon number of at least 8 and no greater than 22 can also yield a resin having the repeating unit (1-1). For example, "EPOCROS (registered Japanese trademark) WS-300" manufactured by NIPPON S-HOKUBAI CO., LTD. contains a copolymer (water soluble crosslinking agent) of methyl methacrylate and a compound (5) containing a hydrogen atom as $R^5$. When such a copolymer (EPOCROS WS-300) reacts with a fatty acid having a carbon chain having a carbon number of at least 8 and no greater than 22, the aforementioned compound (1) can be yielded.

In order to form a high-quality image using the toner, the toner preferably has a volume median diameter ($D_{50}$) of at least 3 μm and less than 10 μm.

Preferably, the shell layers cover at least 80% and no greater than 99% of a total surface area of the toner cores and more preferably at least 70% and no greater than 95% in order to improve both high-temperature preservability and low-temperature fixability of the toner.

The following describes, in order, the toner cores (binder resin and internal additives), the shell layers, and external additives. An unnecessary component may be omitted according to use of the toner.

[Toner Core]

(Binder Resin)

The binder resin is typically a main component (for example, at least 85% by mass) of the toner cores. Properties of the binder resin are therefore expected to have great influence on an overall property of the toner cores. A combinational use of a plurality of resins as the binder resin can result in adjustment of a property (specific examples include hydroxyl value, acid value, Tg, and Tm) of the binder resin. The toner cores have a strong tendency to be anionic when the binder resin has a group such as an ester group, a hydroxyl group, an ether group, an acid group, or a methyl group. By contrast, the toner cores have a strong tendency to be cationic when the binder resin has a group such as an amino group or an amide group. At least one of the hydroxyl value and the acid value of the binder resin is preferably at least 10 mgKOH/g in order to enhance bindability (reactivity) between the toner core and the shell layer.

Examples of a preferable binder resin of the toner cores include thermoplastic resins (specific examples include styrene-acrylic acid-based resin and polyester resin) with a polyester resin being particularly preferable.

A styrene-acrylic acid-based resin is a copolymer of for example at least one styrene-based monomer and at least one acrylic acid-based monomer. A polyester resin can be yielded by condensation polymerization of at least one polyhydric alcohol and at least one polybasic carboxylic acid.

Examples of alcohols that can be used for synthesis of a polyester resin include dihydric alcohols (specific examples include aliphatic diols and bisphenols) and tri- or higher-hydric alcohols, as listed below. Examples of carboxylic acids that can be preferably used for synthesis of a polyester resin include dibasic carboxylic acids and tri- or higher-basic carboxylic acids, as listed below.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecandiol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, sebacic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Particularly preferably, the toner cores contain, as the binder resin, a condensation polymer (polyester resin) of at least one α,ω-alkanediol having a carbon number of at least 2 and no greater than 6 and at least one aromatic dicarboxylic acid in order to improve both high-temperature preservability and low-temperature fixability of the toner.

In a situation in which a polyester resin is used as the binder resin of the toner cores, the polyester resin preferably has a number average molecular weight (Mn) of at least 1,000 and no greater than 2,000 in order to improve strength of the toner cores and fixability of the toner. The polyester resin preferably has a molecular weight distribution (ratio (Mw/Min) of a mass average molecular weight (Mw) relative to a number average molecular weight (Mn)) of at least 9 an no greater than 21. Measurement of Mn and Mw of the polyester resin can be done using gel permeation chromatography.

The toner cores preferably have a glass transition point (Tg) of at least 20° C. and no greater than 55° C. in order to improve both high-temperature storage resistance and low-temperature fixability of the toner. The toner cores preferably have a softening point (Tm) of at least 70° C. and no greater than 105° C. in order to improve both high-temperature preservability and low-temperature fixability of the toner.

(Colorant)

The toner cores may optionally contain a colorant. The colorant can be a known pigment or dye that matches the color of the toner. The amount of the colorant is preferably at least 1 part by mass and no greater than 20 parts by mass relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a colorant such as a yellow colorant, a magenta colorant, and a cyan colorant.

One or more compounds selected from the group consisting of condensed azo compounds, isoindolinone compounds, anthraquinone compounds, azo metal complexes, methine compounds, and arylamide compounds can be used for example as a yellow colorant. Specific examples of yellow colorants that can be preferably used include C. 1. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G and C. I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as a magenta colorant. Specific examples of magenta colorants that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as a cyan colorant. Specific examples of cyan colorants that can be preferably used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may optionally contain a releasing agent. The releasing agent is for example used in order to improve fixability of the toner or resistance of the toner to being offset. The toner cores are preferably prepared using an anionic wax in order to increase anionic strength of the toner cores.

Examples of a releasing agent that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. A single releasing agent may be used or a combination of two or more releasing agents may be used.

A compatibilizer may be added to the toner cores in order to improve compatibility between the binder resin and the releasing agent.

(Charge Control Agent)

The toner cores may optionally contain a charge control agent. The charge control agent is for example used in order to improve charge stability or a charge rise characteristic of the toner. The charge rise characteristic of the toner is an indicator as to whether or not the toner can be charged to a specific charge level in a short period of time.

Containment of a negatively chargeable charge control agent (specific examples include an organic metal complex and a chelate compound) in the toner cores can result in an increase in anionic strength of the toner cores. By contrast, containment of a positively chargeable charge control agent (specific examples include pyridine, nigrosine, and quaternary ammonium salt) in the toner cores can result in an increase in cationic strength of the toner core. However, the toner cores need not to contain a charge control agent in a configuration in which sufficient chargeability of the toner can be ensured.

(Magnetic Powder)

The toner cores may optionally contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specifically, thermal treatment). A single magnetic powder may be used or a combination of two or more magnetic powders may be used. Furthermore, the magnetic powder is preferably subjected to surface treatment in order to inhibit elution of metal ions (e.g., iron ions) from the magnetic powder.

[Shell Layer]

The shell layers in the toner having the above basic features contain the specific copolymer (copolymer of at least two vinyl compounds including a compound represented by the above formula (1)). Examples of monomers (vinyl compounds) that can be preferably used for synthesizing the resin (specific copolymer) forming the shell layers are those listed above (see formulas (1) to (5), for example). An example of a preferable specific copolymer that can be contained in the shell layers is a copolymer of monomers (resin material) including at least one (meth)acrylic acid alkyl ester and at least one compound represented by the above formula (1).

[External Additive]

Inorganic particles as an external additive may be attached to the surfaces of the toner mother particles. Unlike the internal additive, the external additive is not present inside the toner mother particles and is selectively present only on the surfaces of the toner mother particles (surface layer portions of the toner particles). For example, stirring the toner mother particles (specifically, a powder containing a plurality of toner mother particles) and an external additive (specifically, a powder containing a plurality of external additive particles) together can cause the external additive particles to be attached to the surfaces of the toner mother particles. The toner mother particles and the external additive particles are bonded together physically rather than chemically without chemical reaction therebetween. Bonding strength between the toner mother particles and the external additive particles can be adjusted through adjustment of stirring conditions (specific examples include time period and rotational speed of stirring) and a particle diameter, a shape, and a surface state of the external additive particles. Preferably, the amount of the external additive is for example at least 0.5 parts by mass and no greater than 10 parts by mass relative to 100 parts by mass of the toner mother particles. The external additive preferably has a particle diameter of at least 0.01 μm and no greater than 1.0 μm in order to improve fluidity and handleability of the toner.

Examples of external additive particles (inorganic particles) that can be preferably used include silica particles and particles of metal oxides (specific examples of the metal oxides include alumina, titanium oxide, magnesium oxide, zinc oxide, strontium titanate, and barium titanate). A single external additive may be used or a combination of two or more external additives may be used.

[Toner Production Method]

The following describes an example of a method for producing a toner having the aforementioned basic features. First of all, toner cores are prepared. Subsequently, the toner cores and a shell material are added to a solvent. The shell material is then caused to react in the solvent to form shell layers substantially formed from a resin on the surfaces of the toner cores.

It is preferable to dissolve or disperse the shell material in the solvent by for example stirring the solvent containing the shell material in order to form uniform shell layers. In order to inhibit dissolution or elution of toner core components (particularly, the binder resin and the releasing agent) during formation of the shell layers, the formation of the shell layers is preferably carried out in an aqueous medium. The aqueous medium is a medium of which main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of a polar medium in the aqueous medium that can be used include alcohols (specific examples include methanol and ethanol). The aqueous medium has a boiling point of about 100° C.

The following describes a toner producing method in further detail by referring to more specific examples.

(Toner Core Preparation)

In order to easily prepare preferable toner cores, the toner cores are preferably produced by an aggregation method or a pulverization method and more preferably by the pulverization method. Typically, toner cores are classified into pulverized cores (also called a pulverized toner) and polymerized cores (also called a chemical toner). Toner cores produced by the pulverization method belong to pulverized cores, while toner cores produced by the aggregation method belong to polymerized cores. The toner cores in the toner having the aforementioned basic features are preferably pulverized cores containing a polyester resin.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is pulverized and then classified. As a result, toner cores having a desired particle size are produced.

An example of the aggregation method will be described below. Respective particulates of a binder resin, a releasing agent, and a colorant are aggregated in an aqueous medium to yield aggregated particles containing the binder resin, the releasing agent, and the colorant. The resultant aggregated particles are then heated to coalesce components contained in the aggregated particles. As a result, a toner core dispersion is obtained. Thereafter, unnecessary substances (for example, a surfactant) are removed from the toner core dispersion to produce toner cores.

(Shell Layer Formation)

Subsequently, the toner cores and a shell material (for example, an oxazoline group-containing water-soluble polymer) are added to an aqueous medium (for example, ion exchanged water).

The oxazoline group-containing polymer dissolved in the aqueous medium is attached to the surfaces of the toner cores in the aqueous medium. In a situation in which it is necessary to uniformly attach the shell material to the surfaces of the toner cores, it is preferable to highly disperse the toner cores in a solvent containing the shell material. In order to highly disperse the toner cores in the solvent, the solvent may contain a surfactant or be stirred using a high-power stirrer (for example, "Hivis Disper Mix" manufactured by PRIMIX Corporation).

Then, a basic substance (for example, an aqueous ammonium solution) is further added to the solvent containing for example the shell material. Subsequently, the solvent is heated up to a predetermined retention temperature (for example, at least 50° C. and no greater than 85° C.) at a specific rate (for example, at least 0.1° C./min. and no greater than 3° C./min.) while being stirred. After completion of temperature increase, a releasability imparting agent is added to the solvent. The releasability imparting agent is an additive for imparting releasability to the shell layers. A linear saturated fatty acid having a carbon number of at least 8 and no greater than 22 is used for example as the releasability imparting agent. The releasability imparting agent (linear saturated fatty acid having a carbon number of at least 8 and no greater than 22) reacts with an oxazoline group-containing compound in the solvent. However, not all part of the oxazoline group-containing compound present in the solvent necessarily reacts with the releasability imparting agent. A part of the oxazoline group-containing compound that does not react with the releasability imparting agent remains in the solvent in an unreacted state.

The temperature of the solvent is then kept at the predetermined retention temperature for a specific time period (for example, at least 30 minutes and no greater than four hours), while the solvent is stirred. A reaction between the toner cores and the shell material (solidification of the shell layers) is thought to proceed during the solvent being kept at high temperature (or being increased in temperature). For example, it is thought that the oxazoline group in the shell material reacts with a functional group present on the surface of the binder resin forming the toner cores to be ring-opened, thereby forming cross-linking structure. Chemical bonding of the shell material to the toner cores forms the shell layers. When the shell layers are formed on the surfaces of the toner cores in the solvent, a dispersion of toner mother particles is obtained.

After formation of the shell layers, the dispersion of the toner mother particles is neutralized for example using sodium hydroxide. The dispersion of the toner mother particles is subsequently cooled for example to normal temperature (about 25° C.). The cooled dispersion of the toner mother particles is filtered for example using a Buchner funnel. Through the above, the toner mother particles are separated from the solvent (solid-liquid separation), thereby obtaining a wet cake of the toner mother particles.

Subsequently, the toner mother particles were washed. The washed toner mother particles are then dried. Thereafter, as needed, the toner mother particles may be mixed with an external additive using a mixer (for example, an FM mixer manufactured by Nippon Coke & Engineering Co., Ltd.) to attach the external additive to the surfaces of the toner mother particles. Note that in a situation in which a spray dryer is used in the drying process, the drying process and the external additive addition process can be carried out simultaneously by spraying a dispersion of an external additive (for example, silica particles) to the toner mother particles. Through the above, a toner including multiple toner particles are produced.

The details and sequence of the above toner producing method may be changed freely as appropriate in accordance with requirements of the toner, such as in terms of composition and properties. For example, the shell material and the toner cores may be added to the solvent at the same time or the toner cores may be added to the solvent prior to or after dissolution of the shell material in the solvent. Also, the shell material may be added to the solvent as a single addition or may be divided up and added to the solvent as a plurality of additions. In a situation in which a material (for example, the shell material) is caused to react in the solvent, the material may be caused to react in the solvent for a predetermined time period after being added to the solvent. Alternatively, the material may be added to the solvent over a long period of time during which the material is caused to react in the solvent. Furthermore, the toner may be sifted after the external additive addition process. In addition, a non-essential process may of course be omitted. For example, in a situation in which a commercially available product can be directly used as a material, use of the commercially available product can result in omission of preparation of the material. In a situation in which an external additive needs not to be attached to the surfaces of the toner mother particles (the external additive addition process is omitted), the toner mother particles are equivalent to toner particles. In a situation in which a resin is synthesized, a monomer or a prepolymer may be used as a material for the resin synthesis. For yielding a specific compound, a salt of the compound, ester, an anhydride, or a hydrate may be used as a material thereof. Respective materials may be used in a solid state or a liquid state. For example, a material of a powder in a solid state may be used. Alternatively, a solution of the material (material in a liquid state dissolved in a solvent) or a dispersion of the material (material dispersed rather than dissolved in a solvent) may be used. Preferably, a large number of toner particles are formed simultaneously in order to produce the toner efficiently. The toner particles produced at the same time are thought to have substantially the same configuration.

EXAMPLES

The following describes examples of the present disclosure. Table 1 indicates toners T-1 to T-12 according to examples and comparative examples that each are an electrostatic latent image developing toner. Note that parenthesized values in a column "Releasing agent" each indicate a mass (unit: parts by mass) of a releasing agent in toner cores relative to 100 parts by mass of a binder resin in the toner cores.

TABLE 1

| | | Shell layer | | |
|---|---|---|---|---|
| | Core Releasing agent | Oxazoline group-containing polymer | Releasability imparting agent | |
| Toner | [part by mass] | [% by mass] | Component | Mass [g] |
| T-1 | 0 | 3 | Octanoic acid | 1 |
| T-2 | 0 | 3 | | 2 |
| T-3 | 0 | 3 | | 3 |
| T-4 | 1 (1.25) | 3 | | 2 |
| T-5 | 2 (2.50) | 3 | | 1 |
| T-6 | 0 | 3 | Dodecanoic acid | 2 |
| T-7 | 0 | 3 | Octadecanoic acid | 2 |
| T-8 | 0 | 3 | Docosanoic acid | 2 |
| T-9 | 5 (6.25) | 0 | — | 0 |
| T-10 | 4 (5.00) | 0 | | 0 |
| T-11 | 3 (3.75) | 0 | | 0 |
| T-12 | 3 (3.75) | 3 | | 0 |

The following describes, in order, production methods, evaluation methods, and evaluation results for toners T-1 to T-12 according to the examples and the comparative examples that each are an electrostatic latent image developing toner. In evaluations in which errors may occur, an evaluation value was calculated by calculating the arithmetic mean of an appropriate number of measured values in order to ensure that any error was sufficiently small.

[Toner Production Method]

(Preparation of Toner Core)

A 5-L reaction vessel equipped with a thermometer (thermocouple), a dewatering conduit, a nitrogen inlet tube, a rectifying column, and a stirrer was set in an oil bath, and 1,200 g of 1,3-propanediol, 1,700 g of terephthalic acid, and 3 g of esterified catalyst (tin(II) 2-ethylhexanoate) were charged into the vessel. Subsequently, the internal temperature of the vessel was increased to 230° C. using the oil bath to cause a reaction (specifically, a condensation reaction) of the vessel content for 15 hours in a nitrogen atmosphere at a temperature of 230° C. The pressure in the vessel was then reduced, and a reaction of the vessel content was caused in a depressurized atmosphere (pressure 8.0 kPa) at a temperature of 230° C. until a reaction product (polyester resin) had a Tm of a specific temperature (90° C.). As a result, a polyester resin having a Tm of 90° C. was yielded.

An FM mixer ("FM-20B" manufactured by Nippon Coke & Engineering Co., Ltd.) was used to mix 80 parts by mass of a binder resin (the polyester resin yielded as above), a releasing agent (ester wax having a melting point of 73° C.: "NISSAN ELECTOR (registered Japanese trademark) WEP-3" manufactured by NOF Corporation) in an amount listed in Table 1, and 9 parts by mass of carbon black ("MA100" manufactured by Mitsubishi Chemical Corporation) for four minutes at a rotational speed of 2,000 rpm. For example, 80 parts by mass of the binder resin, 1 part by mass of the releasing agent, and 9 parts by mass of the carbon black were mixed in production of the toner T-4. No releasing agent was added in production of each of the toners T-1, T-2, T3, T-6, T-7, and T-8.

The resultant mixture was then melt-knead using a two-axis extruder ("PCM-30" manufactured by Ikegai Corp.) under conditions of a shaft rotational speed of 150 rpm, a set temperature range (cylinder temperature) of 100° C., and a processing speed of 100 g/min. Subsequently, the resultant melt-knead substance was cooled. The cooled melt-knead substance was coarsely pulverized to have a set particle diameter of 2 mm using a pulverizer ("Rotoplex (registered Japanese trademark)" manufactured by Hosokawa Micron Corporation). The resultant coarsely pulverized substance was finely pulverized using a pulverizer ("Turbo Mill Type RS" manufactured by FREUND-TURBO CORPORATION). The resultant finely pulverized substance was classified using a classifier ("Elbow Jet Type EJ-LABO" manufactured by Nittetsu Mining Co., Ltd.). As a result, toner cores having a volume median diameter ($D_{50}$) of 6.7 μm, Tin of 90° C., and Tg of 49° C. were prepared.

(Shell Layer Formation Process)

A 1-L three-necked flask equipped with a thermometer and a stirring impeller was set in a water bath, and 300 g of ion exchanged water was charged into the flask. The internal temperature of the flask was then kept at 30° C. using the water bath. An oxazoline group-containing polymer solution ("EPOCROS WS-300" manufactured by NIPPON SHOKUBAI CO., LTD., solid concentration: 10% by mass, Tg: 90° C.) in an amount listed in Table 1 was added to the flask, and then, the flask content was stirred sufficiently. The amounts in Table 1 each indicate a ratio (unit: % by mass) of the oxazoline group-containing polymer relative to 300 g of toner cores that were to be added later. For example, 90 g of the oxazoline group-containing polymer solution (EPOCROS WS-300) was added in production of the toner TA-1. The additive amount (90 g) is calculated as follows: "amount of toner cores (300 g)×amount in Table 1 (0.03)/solid concentration (0.1)=90 g". The toners T-9 to T-11 were each produced without using the oxazoline group-containing polymer solution (EPOCROS WS-300).

Subsequently, 300 g of the toner corers prepared through the above process were added to the flask and the flask content was stirred for one hour at a rotational speed of 200 rpm. Thereafter, 300 g of ion exchanged water was added to the flask.

The flask was then charged with 6 mL of an aqueous ammonium solution at a concentration of 1% by mass. Thereafter, the internal temperature of the flask was increased up to 60° C. at a rate of 0.5° C./min. while the flask content was stirred at a rotational speed of 150 rpm. After completion of the temperature increase, a releasability imparting agent listed in Table 1 in an amount listed in Table 1 was added to the flask. For example, 1 g of an octanic acid (linear saturated fatty acid having a carbon number of 8) was added as a releasability imparting agent in production of the toner T-1. Also, 2 g of dodecanic acid (linear saturated fatty acid having a carbon number of 12) was added as a releasability imparting agent in production of the toner T-6. Yet, 2 g of octadecanoic acid (linear saturated fatty acid having a carbon number of 18) was added as a releasability imparting agent in production of the toner T-7. Still, 2 g of docosanoic acid (linear saturated fatty acid having a carbon number of 22) was added as a releasability imparting agent in production of the toner T-8. No releasability imparting agent was added in production of the respective toners T-9 to T-12.

Subsequently, the temperature (60° C.) was kept for one hour while the flask content was stirred at a rotational speed of 100 rpm.

An aqueous ammonium solution at a concentration of 1% by mass was then added to the flask to adjust the pH of the flask content to 7. The flask content was then cooled to normal temperature (about 25° C.) to obtain a dispersion containing toner mother particles.

(Washing Process)

The dispersion of the toner mother particles obtained as above was filtered (solid-liquid separated) using a Buchner funnel to obtain a wet cake of the toner mother particles. The obtained wet cake of the toner mother particles was re-dispersed in ion exchanged water. Dispersion and filtration were further repeated five times to wash the toner mother particles.

(Drying Process)

Thereafter, the resultant toner mother particles were dispersed in an ethanol solution at a concentration of 50% by mass. Through the above, a slurry of the toner mother particles was obtained. The toner mother particles in the slurry were then dried using a continuous surface-modifying apparatus ("Coatmizer (registered Japanese trademark)" manufactured by Freund Corporation) under conditions of a hot wind temperature of 45° C. and a flow rate of 2 $m^3$/min. As a result, a powder of the toner mother particles was yielded.

(External Additive Addition Process)

Subsequently, the yielded toner mother particles were subjected to external additive addition. Specifically, a 10-L FM mixer (product by Nippon Coke & Engineering Co., Ltd.) was used to mix 100 parts by mass of the toner mother particles and 1 parts by mass of dry silica particulates ("AEROSIL (registered Japanese trademark) REA90" manufactured by Nippon Aerosil Co., Ltd.) for five minutes to attach an external additive (silica particles) to the surfaces of the toner mother particles. A resultant powder was sifted using a 200-mesh (opening size 75 μm) sieve. As a result, a toner (toners T-1 to T-12) including multiple toner particles was obtained.

[Evaluation Methods]

Methods for evaluating samples (toners T-1 to T-12) are as follows.

(Charge Decay Characteristic)

A charge decay constant α of each sample (toner) was measured by a method in accordance with JIS C 61340-2-1-2006 using an electrostatic diffusivity measuring device ("NS-D100" manufactured by Nano Seeds Corporation). The following describes in detail the method for measuring the charge decay constant of a toner.

The sample (toner) was loaded in a measurement cell. The measurement cell was a metal cell with a recess having an inner diameter of 10 mm and a depth of 1 mm. The sample was loaded into the recess of the cell, pressing on the sample from above using slide glass. Any of the sample that overflowed from the cell was removed by moving the slide glass back and forth on the surface of the cell. At least 0.04 g and no greater than 0.06 g of the sample was loaded into the cell.

Next, the measurement cell having the sample (toner) loaded therein was left for 12 hours in ambient conditions of 32° C. and 80% relative humidity. The grounded measurement cell was subsequently placed in the electrostatic dissipation measuring device in the ambient conditions of 32° C. and 80% relative humidity, and ions were supplied to the sample by corona discharge to charge the sample. The electrostatic dissipation measuring device was set to have a probe gap of 1 mm, and the sample was charged for 0.5 seconds. The surface potential of the sample was measured continuously starting from 0.7 seconds after completion of the corona discharge under a condition of a sampling frequency of 1 Hz. A charge decay constant (charge decay rate) a. was calculated based on the measured surface potential and an equation "$V=V_0\exp(-\alpha\sqrt{t})$". In the equation: V represents a surface potential [V]; $V_0$ represents an initial surface potential [V]; and t represents a charge decay period [second].

A charge decay constant of less than 0.030 was evaluated as good, and a charge decay constant of at least 0.030 was evaluated as poor.

(Preparation of Evaluation Developer)

An evaluation developer prepared by the following method was used in evaluation of releasability and reverse chargeability.

In ambient conditions of 25° C. and 50% relative humidity, 100 parts by mass of a developer carrier (carrier for "TASKalfa7551ci" manufactured by KYOCERA Document Solutions Inc.) and 8 parts by mass of a sample (toner) were mixed for 30 minutes using a ball mill to yield an evaluation developer (two-component developer).

(Releasability)

Releasability was evaluated using a color printer ("FS-C5250DN" manufactured by KYOCERA Document Solutions Inc., modified to enable adjustment of fixing temperature) having a roller-roller type heat-pressure fixing section (nip width 8 mm) as an evaluation apparatus. The evaluation developer prepared through the above process was loaded into a developing device of the evaluation apparatus, and the sample (toner for replenishment use) was loaded into a toner container of the evaluation apparatus.

A solid image having a size of 25 mm by 25 mm was formed on paper having a basis weight of 90 g/m$^2$ (A4-size evaluation paper) in ambient conditions of 25° C. and 50% relative humidity using the evaluation apparatus under conditions of a linear velocity of 200 mm/sec. and a toner applied amount of 1.0 mg/cm$^2$. Next, the paper having the image formed thereon was passed through the fixing section of the evaluation apparatus.

Releasability of the toner was evaluated in a fixing temperature range of at least 120° C. and no greater than 200° C. Specifically, a maximum temperature at which the paper after fixing could be smoothly ejected (without contact with a separation plate of the evaluation apparatus), that is, a maximum fixing temperature was measured by increasing the fixing temperature of the fixing section from 120° C. in increments of 2° C. Smooth ejection of the paper after fixing was confirmed by observing whether or not a trace evidencing contact of the paper with the separation plate of the evaluation apparatus was left in the solid image on the paper having been passed through the fixing device. Specifically, it is determined that the paper after fixing was not smoothly ejected in a situation in which a trace of the separation plate was left in the solid image. Note that the separation plate is a member (fixing separation member) that is disposed at an outlet of the fixing device and that separates paper having been passed through the fixing device from a fixing roller (specifically, a heating roller) of the fixing device when the paper clings to the fixing roller due to viscosity of melted toner.

A maximum fixing temperature of at least 160° C. was evaluated as good, and a maximum fixing temperature of less than 160° C. was evaluated as poor.

(Reverse Chargeability)

A color printer ("ECOSYS (registered Japanese trademark) FS-C5400DN" manufactured by KYOCERA Document Solutions Inc.) was used as an evaluation apparatus. A rate of reversely charged toner particles (unit: % by mass) was calculated for a toner on a developing sleeve of the evaluation apparatus.

The evaluation developer prepared through the above process was charged into a developing device of the evaluation apparatus. The developing device includes a development roller having a length of 230 mm and a diameter of 20 mm. The development roller had a SUS304-made cylinder (developing sleeve) in which a magnet (magnet roll) was disposed.

Based on image forming operation of the evaluation apparatus, 3 g of evaluation developer was uniformly loaded on the developing sleeve. A cylindrical electrode was placed opposite to the developing sleeve in the above state with 5-mm distance apart therefrom. Subsequently, voltage was applied to the electrode while the developing sleeve was rotated at a rotational speed of 500 rpm to generate an electric field having an electric field intensity of 1 kV/cm, thereby collecting only toner of the developer on the developing sleeve. A rate of reversely charged toner particles contained in the collected toner (unit: % by mass) was measured using a particle size and electrostatic charge distribution analyzer ("E-spart Analyzer (registered Japanese trademark) EST-II" manufactured by Hosokawa Micron Corporation).

A rate of reversely charged toner particles of no greater than 0.4% by mass was evaluated as good and a rage of reversely charged toner particles of greater than 0.4% by mass was evaluated as poor.

[Evaluation Results]

Table 2 indicates evaluation results (charge decay characteristic: charge decay constant, releasability: maximum fixing temperature, reverse chargeability: rate of reversely charged toner particles) for the toners T-1 to T-12.

TABLE 2

| | Toner | Charge decay | Releasability [° C.] | Reverse chargeability [% by mass] |
|---|---|---|---|---|
| Example 1 | T-1 | 0.028 | 162 | 0.0 |
| Example 2 | T-2 | 0.021 | 166 | 0.1 |
| Example 3 | T-3 | 0.011 | 170 | 0.1 |
| Example 4 | T-4 | 0.020 | 168 | 0.2 |
| Example 5 | T-5 | 0.024 | 166 | 0.4 |

TABLE 2-continued

| | Toner | Charge decay | Releasability [° C.] | Reverse chargeability [% by mass] |
|---|---|---|---|---|
| Example 6 | T-6 | 0.018 | 168 | 0.1 |
| Example 7 | T-7 | 0.015 | 170 | 0.1 |
| Example 8 | T-8 | 0.010 | 172 | 0.1 |
| Comparative Example 1 | T-9 | 0.026 | 166 | 0.8 (poor) |
| Comparative Example 2 | T-10 | 0.028 | 162 | 0.6 (poor) |
| Comparative Example 3 | T-11 | 0.031 (poor) | 158 (poor) | 0.5 (poor) |
| Comparative Example 4 | T-12 | 0.024 | 156 (poor) | 0.4 |

The toners T-1 to T-8 (toners of Examples 1 to 8) each had the aforementioned basic features. Specifically, the toners T-1 to T-8 each had shell layers containing a copolymer of at least two vinyl compounds including a compound represented by the above formula (1). As indicated in Table 2, the toners T-1 to T-8 each were excellent in charge decay characteristic, reverse chargeability, and releasability.

Note that the toner T-1 was evaluated as good in all the evaluations even when a styrene-based monomer (styrene) was further added in the shell layer formation process in addition to the oxazoline group-containing polymer solution (EPOCROS WS-300) in production of the toner T-1.

What is claimed is:

1. An electrostatic latent image developing toner comprising a plurality of toner particles each including a core containing a binder resin and a shell layer covering a surface of the core, wherein the shell layer contains a copolymer of at least two vinyl compounds including a compound represented by formula (1) shown below:

(1)

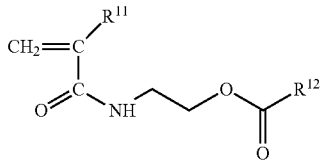

in the formula (1), $R^{11}$ represents a hydrogen atom or an optionally substituted alkyl group having a carbon number of at least 1 and no greater than 8, and $R^{12}$ represents an optionally substituted linear alkyl group having a carbon number of at least 8 and no greater than 22.

2. The electrostatic latent image developing toner according to claim 1, wherein the at least two vinyl compounds includes at least one vinyl compound selected from the group consisting of styrene-based monomers and acrylic acid-based monomers.

3. The electrostatic latent image developing toner according to claim 1, wherein the copolymer contained in the shell layer is a copolymer of monomers including at least one (meth)acrylic acid alkyl ester and the at least one compound represented by the formula (1).

4. The electrostatic latent image developing toner according to claim 1, wherein in the formula (1), $R^{11}$ represents a group selected from the group consisting of a hydrogen atom, a methyl group, an ethyl group, and a propyl group, and $R^{12}$ represents a group selected from the group consisting of an octyl group, a decyl group, a dodecyl group, an octadecyl group, and a docosyl group.

5. The electrostatic latent image developing toner according to claim 1, wherein the core contains a releasing agent, and the releasing agent contained in the core is present in an amount of greater than 0.00 parts by mass and no greater than 2.50 parts by mass relative to 100 parts by mass of the binder resin.

6. The electrostatic latent image developing toner according to claim 1, wherein the core contains no releasing agent.

7. The electrostatic latent image developing toner according to claim 1, wherein the copolymer contained in the shell layer has a repeating unit represented by formula (A) shown below:

(A)

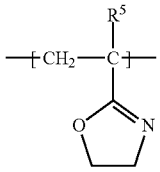

in the formula (A), $R^5$ represents a hydrogen atom or an optionally substituted alkyl group having a carbon number of at least 1 and no greater than 8.

8. The electrostatic latent image developing toner according to claim 7, wherein the core contains a polyester resin as the binder resin.

9. The electrostatic latent image developing toner according to claim 8, wherein the polyester resin is a condensation polymer of at least one aromatic dicarboxylic acid and at least one α,ω-alkanediol having a carbon number of at least 2 and no greater than 6.

10. The electrostatic latent image developing toner according to claim 8, wherein the core is a pulverized core.

* * * * *